United States Patent [19]

Marshall et al.

[11] 4,126,564

[45] Nov. 21, 1978

[54] SPIN FINISH FOR POLYAMIDE CARPET YARN

[75] Inventors: Robert M. Marshall, Chester; Kimon C. Dardoufas, Richmond, both of Va.

[73] Assignee: Allied Chemical Corporation, Morris Township, Morris County, N.J.

[21] Appl. No.: 859,762

[22] Filed: Dec. 12, 1977

[51] Int. Cl.[2] ..... D06M 13/10

[52] U.S. Cl. ..... 252/8.9; 252/8.75; 252/52 A; 427/434 D; 428/395

[58] Field of Search ..... 252/8.9, 8.75, 8.6, 252/52 A; 427/434 D; 428/395

[56] References Cited

U.S. PATENT DOCUMENTS

| | | | |
|---|---|---|---|
| 3,198,732 | 8/1965 | Olney | 252/8.9 |
| 3,248,258 | 4/1966 | Coats | 252/8.9 |
| 3,341,452 | 9/1967 | Cooley | 252/8.9 |
| 3,575,856 | 4/1971 | Anton | 252/8.9 |
| 3,781,202 | 12/1973 | Marshall et al. | 252/8.7 |

*Primary Examiner*—William E. Schulz
*Attorney, Agent, or Firm*—Fred L. Kelly

[57] ABSTRACT

A spin finish composition for polyamide yarn to be processed into plied, bulked, continuous filament carpet yarn, comprising coconut oil, polyoxyethylene hydrogenated castor oil and the potassium salt of polyoxyethylene tridecyl alcohol phosphate. This finish improves processing of the yarn at high temperature, as by steam jet texturing, and prevents excessive tension build-up during subsequent cabling operations.

8 Claims, No Drawings

SPIN FINISH FOR POLYAMIDE CARPET YARN

BACKGROUND OF THE INVENTION

This invention relates to a yarn finish. More particularly, this invention relates to a spin finish for polyamide feeder yarn to be processed into plied, bulked, continuous filament carpet yarn by texturing and cabling operations.

Various finishes for synthetic filaments are known. However, none of the prior art teaches the required combination of ingredients to achieve the specific beneficial results of the composition of this invention. The critical ingredients and amounts thereof are shown in the discussion below.

Many of the known finishes flash off of the yarn in high temperature processing, particularly in steam jet texturing. Others cause excessive tension build-up during cabling operations. Still others fail to have emulsion stability or provide insufficient yarn lubrication. Representative prior art patents include U.S. Pat. No. 2,565,403 to Sproule et al.,
U.S. Pat. No. 3,198,732 to Olney,
U.S. Pat. No. 3,306,850 to Olsen,
U.S. Pat. No. 3,672,977 to Dardoufas, and
U.S. Pat. No. 3,687,721 to Dardoufas.

It has been suggested that coconut oil mixed with a suitable sulfonated natural petroleum product and other essential ingredients may be emulsified with water so as to minimize the quantity of lubricant required and provide an unusually even distribution of finish on the yarn. For example, our recent U.S. Pat. No. 3,781,202 discloses a spin finish for polyamide yarn to be processed at high temperature, said finish being an oil in water emulsion of about 10 to 20 percent by weight of said oil portion, said oil portion consisting essentially of coconut oil, polyoxyethylene castor oil, decaglycerol tetraoleate, glycerol monooleate, polyoxyethylene sorbitan monooleate, polyoxyethylene tallow glyceride, and sulfonated petroleum product.

In the production of bulked, continuous filament carpet yarn from a feeder yarn bearing the spin finish disclosed in U.S. Pat. No. 3,781,202, difficulty has often been experienced in that yarn bearing this finish is not very suitable for high-speed cabling operations to form twist plied yarn because of excessive tension build-up during cabling. The term "cabling" is conventionally used in this art to mean the production of twist plied yarn, and a suitable method and apparatus for twist plied yarn is described in U.S. Pat. No. 3,820,316 to Clarkson. Cabling operations are normally used in fabrication of tufting yarn, which may be utilized in the manufacture of shag carpeting and the like. Typically, a first single end of yarn having no more than a producers twist is plied with a second single end of yarn while both are under tension and advancing at a common linear speed. Since tension on the yarn is maintained by high friction, it is critical that the spin finish on the yarn not interfere with maintaining a relatively constant friction during running.

SUMMARY OF THE INVENTION

It is a primary object of the present invention to provide a spin finish for polyamide yarn to be processed at high tension into plied, bulked, continuous filament carpet yarn.

It is another object of the present invention to provide a spin finish for polyamide yarn to be processed into carpet yarn by conventional texturing and cabling operations involving high temperature and high friction.

It is a further object of this invention to provide a spin finish for polyamide yarn, which has excellent stability to high temperature process conditions, provides lubrication, static protection and plasticity to the yarn for subsequent drawing and steam jet texturing and/or producing plied, bulked continuous filament carpet yarn.

These and other objects of this invention are provided by a finish of an oil in water emulsion of about 10 to 20 percent by weight of the oil portion. The oil portion consists essentially of from about 55 to 65 percent by weight of coconut oil, about 20 to 35 percent by weight of polyoxyethylene hydrogenated castor oil, and about 7 to 15 percent by weight of the potassium salt of polyoxyethylene tridecyl phosphate. Preferably, the coconut oil is refined coconut glyceride, the ethoxylated hydrogenated castor oil contains about 14 to 18 moles of ethylene oxide per mole of hydrogenated castor oil, and the ethoxylated tridecyl phosphate, potassium salt, contains about 4 to 6 moles of ethylene oxide per mole of tridecyl phosphate, potassium salt.

Since very little of this finish flashes off in high temperature processing, about 0.5 to 1.2 percent by weight of yarn, of oil is applied as spin finish, and about 0.5 to 1.2 percent by weight of yarn, of oil remains on the yarn after high temperature processing.

DESCRIPTION OF THE PREFERRED EMBODIMENTS

Table I shows the finish composition of the preferred embodiment of this invention. Table II shows the criticality of the amounts of ingredients necessary in order to provide a stable emulsion. Note that only the finish identified as A provides excellent emulsion stability after 48 hours. Varying the amounts of the various components results in only fair or poor emulsion stability.

TABLE I

| FINISH COMPOSITION | Weight Percent |
|---|---|
| Refined coconut glyceride | 60 |
| Polyoxyethylene (16)[a] hydrogenated castor oil | 30 |
| Polyoxyethylene (5)[a] tridecyl phosphate, potassium salt | 10 |

[a] = Moles of ethylene oxide per mole of base material

TABLE II

| FINISH COMPOSITIONS | Weight Percent | | | | | | | | |
|---|---|---|---|---|---|---|---|---|---|
| Finish Components | A | B | C | D | E | F | G | H | |
| Refined Coconut Glyceride | 60 | 60 | 60 | 50 | 55 | 60 | 60 | 60 | Lubricant |
| Polyoxyethylene (16)[a] Hydrogenated Castor Oil | 30 | 25 | 35 | 30 | 25 | 20 | 17 | 23 | Emulsifier |
| Polyoxyethylene (5)[a] Tridecyl Phosphate, Potassium Salt | 10 | 15 | 5 | 20 | 20 | 20 | 23 | 17 | Antistat Emulsifier |

TABLE II-continued

| FINISH COMPOSITIONS | Weight Percent | | | | | | | |
|---|---|---|---|---|---|---|---|---|
| Finish Components | A | B | C | D | E | F | G | H |
| Emulsion Stability* After 48 Hours (Emulsion Contains 20 Percent by Weight of Oil Portion in Water) | E | P | F | P | P | F | P | P |

[a] = Moles of ethylene oxide per mole of base material.
*E = Excellent - Translucent bluish-white; particle size less than 1 micron. No separation.
*F = Fair - Milky white; particle size up to 4 microns. Slight ring of oil separation on surface.
*P = Poor - Chalky white; particle size above 4 microns. Creaming on surface.

The invention will now be further described in the following specific examples which are to be regarded solely as illustrative and not as restricting the scope of the invention. In the following examples, parts and percentages employed are by weight unless otherwise indicated.

EXAMPLE 1

A reactor equipped with a heater and stirrer is charged with a mixture of 1,520 parts of epsilon-caprolactam and 80 parts of aminocaproic acid. The mixture is then flushed with nitrogen and stirred and heated to 255° C. over a 1-hour period at atmospheric pressure to produce a polymerization reaction. The heating and stirring is continued at atmospheric pressure under a nitrogen sweep for an additional 4 hours in order to complete the polymerization. Nitrogen is then admitted to the reactor and a small pressure is maintained while the polycaproamide polymer is extruded from the reactor in the form of a polymer ribbon. The polymer ribbon is subsequently cooled, pelletized, washed and dried. The polymer is a white solid having a relative viscosity of about 50 to 60 as determined at a concentration of 11 grams of polymer in 100 ml. of 90 percent formic acid at 25° C. (ASTM D-789-62T).

The polymer pellets are melted at about 285° C. and melt extruded under pressure of about 1,500 psig. through a 70-orifice spinnerette to produce an undrawn yarn having about 3,600 denier. The finish composition of Table I, above, is applied to the yarn as a spin finish in amount to provide about 0.9 percent by weight of oil on the yarn. The yarn is then drawn at about 3.2 times the extruded length and textured with a steam jet to produce a feeder yarn suitable for production of plied, bulked, continuous filament carpet yarn. This feeder yarn will hereinafter be called Yarn A. A control yarn is prepared in the same manner as described above except that the preferred finish of U.S. Pat. No. 3,781,202 is used. The control yarn will hereinafter be called Yarn B.

Each yarn is then two-plied to form plied, bulked, continuous filament yarn using a direct cabling process such as that described in U.S. Pat. No. 3,820,316. In the method, a first single end of yarn is ballooned about and plied with a like single end of yarn while both are under high tension and advancing at a common linear speed. This high speed process requires that the feeder yarns be kept under a relatively constant, relatively high tension, e.g., 150 to 300 grams for a 1100 denier yarn. The following tension phenomena is observed for Yarn A and Yarn B using a fixed friction setting:

TABLE III

| Yarn Sample | Tension in Grams | | | |
|---|---|---|---|---|
| | At Start | After 5 Minutes | After 15 Minutes | After 30 Minutes |
| Yarn A | 300 | 300 | 300 | 300 |

TABLE III-continued

| Yarn Sample | Tension in Grams | | | |
|---|---|---|---|---|
| | At Start | After 5 Minutes | After 15 Minutes | After 30 Minutes |
| Yarn B | 300 | 350 | 500 | 750 |

The dramatic increase in tension for control Yarn B shows that it is unaccceptable for this high speed cabling operation. Also, kinking of Yarn B is observed, which makes it useless for tufting into carpets. On the other hand, the constant tension values for Yarn A show that it is highly accceptable for high speed cabling. Moreover, when made into carpets, the tufting performance of Yarn A is excellent.

EXAMPLE 2

In additional comparative tests, it is found that the polyoxyethylene hydrogenated castor oil component of the finish is very critical, i.e., poor results are obtained when the following compounds are substituted for the polyoxyethylene hydrogenated castor oil component of the finish:

(a) polyoxyethylene castor oil
(b) polyoxyethylene pelargonate
(c) polyoxyethylene laurate
(d) polyoxyethylene oleyl ether
(e) polyoxyethylene oleate Moreover, poor results are obtained when various sodium petroleum sulfonates are substituted for the potassium salt of polyoxyethylene tridecyl phosphate.

DISCUSSION

Although the spin finish of the present invention is particularly critical for yarn to be used under high tension in high speed cabling operations, it also provides many other benefits. The following is a list of additional benefits of the composition of this invention:

1. It is nonfuming, i.e., it does not flash off in high temperature processing such as steam jet texturing.
2. It has excellent emulsion stability.
3. This spin finish lubricates the yarn even after passing through high temperature processing such as steam jet.
4. The finish improves texturing performance.
5. An even distribution of the finish is achieved.
6. The finish prevents static buildup.
7. Plasticity is imparted to the yarn.
8. Tuftability of the carpet yarn is improved.

We claim:

1. A spin finish for polyamide yarn to be processed at high temperature and high tension into plied, bulked, continuous filament carpet yarn, said finish being an oil in water emulsion of about 10 to 20 percent by weight of said oil portion, said oil portion consisting essentially of from about 55 to 65 percent by weight of coconut oil, about 20 to 35 percent by weight of polyoxyethylene hydrogenated castor oil, and about 7 to 15 percent by weight of potassium salt of polyoxyethylene tridecyl phosphate.

2. The spin finish of claim 1 wherein the coconut oil is refined coconut glyceride.

3. The spin finish of claim 1 wherein the ethoxylated hydrogenated castor oil contains about 14 to 18 moles of ethylene oxide per mole of hydrogenated castor oil.

4. The spin finish of claim 1 wherein the ethoxylated tridecyl phosphate, potassium salt, contains about 4 to 6 moles of ethylene oxide per mole of tridecyl phosphate, potassium salt.

5. In a process for production of plied, bulked, continuous filament polyamide carpet yarn from steam textured polyamide yarn, wherein a first single end of said steam textured polyamide yarn is ballooned about and plied with a like single end of yarn while both are under tension and advancing at a common linear speed, the improvement wherein the yarn is treated during spinning with 0.5 to 1.2 percent by weight of said yarn of a spin finish, said finish being an oil in water emulsion of about 10 to 20 percent by weight of said oil portion, said oil portion consisting essentially of from about 55 to 65 percent by weight of coconut oil, about 20 to 35 percent by weight of polyoxyethylene hydrogenated castor oil, and about 7 to 15 percent by weight of potassium salt of polyoxyethylene tridecyl phosphate.

6. The process of claim 5 wherein the coconut oil is refined coconut glyceride.

7. The process of claim 5 wherein the ethoxylated hydrogenated castor oil contains about 14 to 18 moles of ethylene oxide per mole of hydrogenated castor oil.

8. The spin finish of claim 5 wherein the ethoxylated tridecyl phosphate, potassium salt, contains about 4 to 6 moles of ethylene oxide per mole of tridecyl phosphate, potassium salt.

* * * * *